US005139587A

United States Patent [19]

Strecker et al.

[11] Patent Number: 5,139,587

[45] Date of Patent: Aug. 18, 1992

[54] COMPOSITE SOLID PROPELLANT WITH A PULVERULENT METAL/OXIDIZER AGGLOMERATE BASE

[75] Inventors: Rüdiger Strecker; Alois Harrer, both of Waldkraiburg, Fed. Rep. of Germany

[73] Assignee: Bayern-Chemie GmbH, Aschau, Fed. Rep. of Germany

[21] Appl. No.: 40,395

[22] Filed: May 10, 1979

[30] Foreign Application Priority Data

May 12, 1978 [DE] Fed. Rep. of Germany ..... 2820969

[51] Int. Cl.[5] ..... C06B 45/10

[52] U.S. Cl. ..... 149/19.9; 60/207; 149/19.2; 149/22; 149/76; 149/119

[58] Field of Search ..... 60/207, 208; 149/192., 149/19.9, 22, 119, 76, 20

[56] References Cited

U.S. PATENT DOCUMENTS

| | | | |
|---|---|---|---|
| 3,068,641 | 12/1962 | Fox | 60/207 |
| 3,476,622 | 11/1969 | Harada et al. | 149/19.9 |
| 3,646,174 | 2/1972 | Macvi | 149/22 |
| 3,753,811 | 8/1973 | Julian et al. | 149/22 |
| 3,761,330 | 9/1973 | Lou et al. | 149/19.2 |
| 3,873,385 | 3/1975 | Henrich et al. | 149/19.9 |
| 3,986,909 | 10/1976 | Macvi | 149/19.9 |
| 4,000,024 | 12/1976 | Roberto et al. | 149/19.9 |
| 4,133,173 | 1/1979 | Schadow | 60/207 |
| 4,141,768 | 2/1979 | Lo et al. | 149/19.3 |

OTHER PUBLICATIONS

Hawley, "The Condensed Chemical Dictionary", 9th Ed., p. 210, Van Nostrand Reinhold Co. (1977) New York.

*Primary Examiner*—Edward A. Miller
*Attorney, Agent, or Firm*—Felfe & Lynch

[57] ABSTRACT

A composite solid propellant with a stable burning rate comprising ammonium perchlorate, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and, optionally, inorganic fluorides, plasticizers and burning rate moderators, wherein ammonium perchlorate together with one or more of said finely pulverized metals, as well as, optionally, said inorganic fluorides are present as an agglomerate of larger particles having a particle size of between 100 μm and 2,000 μm.

8 Claims, No Drawings

COMPOSITE SOLID PROPELLANT WITH A PULVERULENT METAL/OXIDIZER AGGLOMERATE BASE

BACKGROUND OF THE INVENTION

The present invention relates to a composite solid propellant with a stable burning rate on the basis of ammonium perchlorate, telomeric binders with terminal functional groups or functional groups statistically distributed along the chain, which are hardened with corresponding hardeners into rubber-elastic products, finely pulverized, readily oxidizable metals such as magnesium, aluminum and zirconium and/or semi-metals such as boron and silicon, and, optionally, inorganic fluorides, as well as plasticizers and burning rate moderators.

The solid propellants which are used as energy sources for rockets usually contain the oxygen required for combustion in the form of solid oxidizers. In contrast thereto, in air-breathing boosters, oxygen from the air is used with simultaneous employment of a strongly underbalanced composite propellant. A strongly underbalanced composite propellant is one where the amount of oxidizer is greatly insufficient to oxidize the finely-pulverized metals. A significant increase in output or range is thereby made possible, because in place of solid oxidizers additional fuel can be carried. If this fuel partly consists of the metals magnesium, aluminum or zirconium or the semi-metals boron or silicon, propellants are obtained which, when burned with air, are far superior not only over the conventional rocket propellants but also over hydrocarbon/air system such as kerosene/air, for example.

A further increase in performance with equal dimensions of the rocket motor can be achieved if the missile is capable of flying so-called high/deep-profiles. The prerequisite for this is that the mass throughput of the propellant is well regulatable, that is, that the propellant possesses a high pressure exponent n. Here lies the disadvantage of the heretofore employed underbalanced composite propellants, primarily when finely divided metallic boron is used, which all exhibit a pressure exponent that is unsuitable for regulating the mass throughput.

OBJECTS OF THE INVENTION

It is an object of the invention to provide a composite propellant for air-breathing boosters, which can be well regulated with respect to its burn properties.

Another object of the present invention is the obtaining of a composite solid propellant with a stable burning rate comprising ammonium perchlorate, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and, optionally, inorganic fluorides, plasticizers and burning rate moderators, wherein ammonium perchlorate together with one or more of said finely pulverized metals, as well as, optionally, said inorganic fluorides are present as an agglomerate of larger particles having a particle size of between 100 μm and 2,000 μm.

A further object of the present invention is the production of an agglomerated boron/ammonium perchlorate for use in a solid propellant having a stable burning rate consisting essentially of from 19% to 61% by weight of ammonium perchlorate with an average particle size of 0.4 to 10 μm; from 38% to 75% by weight of boron with a purity of 86% to 99% and an average particle size of 0.5 μm to 5 μm; from 0 to 6% by weight of fluorides selected from the group consisting of alkali metal fluorides and cryolites of the alkali metals of the formula $$Me_3AlF_6$$

where M is an alkali metal as well as an agglomeration auxiliary agent in amounts of from 1% to 10% by weight.

These and other objects of the present invention will become more apparent as the description thereof proceeds.

DESCRIPTION OF THE INVENTION

The drawbacks of the prior art overcome and the above objects are achieved according to the present invention if ammonium perchlorate together with one or more of the finely powdered metals and/or semi-metals as well as, optionally, the inorganic fluorides, as agglomerate of larger particles, is contained in the composite solid propellant.

More particularly, therefore, the present invention relates to a composite solid propellant with a stable burning rate comprising ammonium perchlorate, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and, optionally, inorganic fluorides, plasticizers and burning rate moderators, wherein ammonium perchlorate together with one or more of said finely pulverized metals, as well as, optionally, said inorganic fluorides are present as an agglomerate of larger particles having a particle size of between 100 μm and 2,000 μm.

Merely by agglomeration of the metal or semi-metal used as the principal fuel with the oxidizer ammonium perchlorate, the pressure exponent can surprisingly be increased four- to seven-fold over composite propellants in which the components boron and ammonium perchlorate are added in the same mixture ratio but separately. The quality of the boron/ammonium perchlorate agglomerates (hereinafter referred to as Borap), the preparation of which is described in the examples, has a decisive significance for the utilization and the burn behavior. The indicated compositions of Borap represents, of course, only one of many possible compositions.

Of course, in addition to boron as a metal or ammonium perchlorate as an oxidizer, other conventional metals and/or oxidizers may be agglomerated in the same fashion.

A preferred embodiment of the invention provides that the agglomerate consists of from 19% to 61% by weight of ammonium perchlorate with an average particle size of 0.04 μm to 10 μm; from 38% to 75% by weight of boron with a purity of 86% to 99%, preferably 95% to 97%, and an average particle size of 0.5 μm to 5 μm; 0% to 6% by weight of fluorides of the alkali metals and/or cryolites of the alkali metals of the formula $Me_3AlF_6$ where M is an alkali metal as well as an agglomeration auxiliary agent in amounts of 1% to 10% by weight, preferably 4% to 6% by weight.

More particularly, the invention also resides in an agglomerated boron/ammonium perchlorate for use in a solid propellant having a stable burning rate consisting essentially of from 19% to 61% by weight of ammonium perchlorate with an average particle size of 0.4 μm to 10 μm; from 38% to 75% by weight of boron with a purity of 86% to 99% and an average particle size of 0.5 μm to 5 μm; from 0 to 6% by weight of fluorides selected from the group consisting of alkali metal fluorides and cryolites of the alkali metals of the formula $Me_3AlF_6$ where M is an alkali metal
as well as an agglomeration auxiliary agent in amounts of from 1% to 10% by weight.

By virtue of the presence of inorganic fluorides of the first and second main group of the periodic system or double fluorides with elements of the third main group in concentrations of 1% to 5% by weight in the agglomerate, a composite solid propellant with improved combustion effect degrees is achieved. Preferred compounds, therefore, are the alkali metal fluorides, such as LiF, NaF, Kf, the alkaline earth metal fluorides, such as $MGF_2$ $CaF_2$, as well as the double fluorides $NaBF_4$, $Li_3AlF_6$, $Na_3AlF_6$, $K_3AlF_6$.

This agglomerate, pursuant to a further characteristic has a particle size between 100 μm and 2,000 μm, preferably between 200 μm and 1,200 μm. The agglomeration auxiliary agent consists, in accordance with an advantageous embodiment, of organic solvent-soluble polymers, such as polymethylmethacrylate, polystyrene, polyamides, polyvinylpyrrolidone or polyester resins.

In accordance with a further embodiment of the invention, the composite solid propellant has the following composition (in percent by weight):

Agglomerate 40% to 80%,
Metals 0% to 15%,
Binder system (binders, plasticizers auxiliaries) 10% to 40%,
Burning rate moderators 0% to 5%.

For increasing the output of air-breathing boosters, one or more light metals, their alloys, semi-metals or metals are added to the propellant. In most cases, the propellant contains several of the above-mentioned components. These fuels, which are present in finely pulverized form with a particle size between 0.5 μm and 20 μm are employed in amounts of 25% to 60%, preferably between 40% and 50%. Suitable light metals are, for example, magnesium and aluminum. Suitable semi-metals are boron and silicon, and a suitable metal is zirconium. As already mentioned, these fuels are agglomerated with the ammonium perchlorate oxidizer and possibly the inorganic fluorides into larger particles prior to use.

The oxidizers, which are employed in concentrations of 15% to 40%, consist of alkali metal, ammonium and alkaline earth metal salts of nitric acid and/or perchloric acid. For this purpose, the employment of ammonium perchlorate and/or sodium nitrate proves to be particularly advantageous. Other oxidizers which may be used within the scope of the invention are the nitramines, RDX, HMX, nitroguanidine, guanidine nitrate, triaminoguanidine nitrate, etc.

Preferred as binders are telomeric polymers, such as polybutadienes or copolymers of butadiene and acrylonitrile, polyesters or polyethers with functional groups. The functional groups may either be in terminal position or statistically distributed along the chain. Typical examples are terminal carboxyl-substituted polyesters and polybutadienes, terminal hydroxyl-substituted polybutadienes and polyesters or copolymers of butadiene and acrylic acid as well as terpolymers of butadiene/acrylic acid/acrylonitrile. The last two are prepared by a complete or partial hydrolysis of a butadiene-acrylonitrile copolymer.

If the functional group consists of a carboxyl group, these polymers can be hardened with various aziridines, epoxides or amines. Polymers with hydroxyl groups are hardened with aliphatic or aromatic di- or polyisocyanates. Depending upon the reactivity of the isocyanate which is used, hardening accelerators or hardening inhibitors are added.

In accordance with a further characteristic of the invention, the binder system consists of 8% to 20% by weight of the total propellant of polybutadiene or copolymers of butadiene and acrylonitrile with functional groups; 0.5% to 5% by weight of the total propellant of hardener; and 0% to 20% by weight of the total propellant of plasticizer.

The binder system may, of course, also be modified with components which do not take part in the hardening process, such as aliphatic or aromatic hydrocarbons and esters with a plasticizing function, process auxiliaries, anti-oxidizing agents, etc.

The compounds which are conventional in propellant technology are used as burning rate moderators. Among these are, for example, iron oxide, copper chromite, copper oxide, manganese oxide, n-butylferrocene, organic iron compounds, such as ferrocene, catocenes, etc. Depending upon the required burning rate of the propellant, these moderators are added in the concentration range of between 0% to 5%.

For further illustration of the invention, the following working examples of the invention are given, which in no way limit the invention. (All amounts in percent by weight.)

EXAMPLE A

Preparation of the Boron/Ammonium Perchlorate Agglomerate - Borap I

5 Parts by weight of polymethylmethacrylate were dissolved in 100 parts by weight of methylene chloride. This solution was introduced into a horizontal mixer with sigma-kneading blades, and 60 parts of metallic boron with a particle size between 0.4 μm and 5.0 μm were added in portions. After thorough mixing, 45 parts by weight of finely milled ammonium perchlorate with an average particle size of about 3 μm were added to the formed mass. After the mass was homogenized by prolonged mixing, the solvent was slowly drawn off at a pressure of 100 to 300 mm Hg at room temperature while continuing the kneading. The kneaded mass is progressively dried thereby and then disintegrates into a grainy agglomerate. By means of screening, the agglomerate with the desired particle size is then continuously removed, whereas the excessively large particles are recycled into the kneading process. The agglomerate is then dried at 80° C. until it has a constant weight. This composition is hereafter referred to as Borap I.

EXAMPLE B

Preparation of the Boron/Ammonium Perchlorate/Fluoride Agglomerate - Borap II A further increase in output of the composite solid propellant can be achieved if additional inorganic fluorides are admixed with the Borap ingredients before agglomeration. These admixtures have no additional effect upon the increase of the pressure exponent, but they significantly improve the combustion effect degree of the propellant. The following example with the designation Borap II represents, of course, only one of many possible compositions:

| Composition of the Borap II agglomerate: | |
|---|---|
| Parts by Weight | |
| 60 | Metallic boron |
| 45 | Ammonium perchlorate |
| 4 | Lithium fluoride |
| 5 | Polymethylmethacrylate |

The preparation of the agglomerate is carried out in analogy to the preparation of Borap I.

| Percent by Weight | |
|---|---|
| 42.0 | Boron |
| 8.0 | Aluminum |
| 25.0 | Ammonium perchlorate |
| 5.0 | n-Butyl-ferrocene |
| 13.0 | Terminal carboxyl-substituted polybutadiene |
| 6.5 | Isodecyl pelargonate |
| 0.5 | Epoxide/aziridine hardener. |

The components are admixed at 70° C. into a pourable mass which, after five days at 80° C., hardens into a rubber-elastic mass. The burn rate at 20° C. and 30 bar is 11 mm/sec. The pressure exponent of the propellant in the range between 30 and 150 bar is 0.10.

EXAMPLE 2

| Percent by Weight | |
|---|---|
| 68.0 | Borap I |
| 8.0 | Aluminum |
| 5.0 | n-Butyl-ferrocene |
| 13.0 | Terminal carboxyl-substituted polybutadiene |
| 5.5 | Isodecyl pelargonate |
| 0.5 | Epoxide/aziridine hardener. |

The compounding is carried out as in the preceding example, and one obtains a rubber-elastic composite propellant with a burn rate of 4.5 mm/sec. at 20° C. and 30 bar. The pressure exponent of the propellant in the range between 30 and 150 bar is 0.48.

EXAMPLE 3

| Percent by Weight | |
|---|---|
| 68.0 | Borap I |
| 7.0 | Aluminum |
| 2.0 | Nitroguanidine |
| 2.0 | n-Butyl-ferrocene |
| 10.0 | Terminal carboxyl-substituted polybutadiene |
| 0.5 | Epoxide/aziridine hardener |
| 10.5 | Naphthenic plasticizer. |

The compounding is carried out as in Example 1. The burn rate of the propellant at 20° C. and 30 bar is 3 mm/sec. The pressure exponent of the propellant in the range between 30 and 150 bar is 0.65.

EXAMPLE 4

Comparison

| Percent by Weight | |
|---|---|
| 45.0 | Boron/LiF-agglomerate of 42% boron and 3% LiF (prepared by the process of Example A) |
| 8.0 | Aluminum |
| 25.0 | Ammonium perchlorate |
| 1.0 | n-Butyl-ferrocene |
| 13.0 | Terminal carboxyl-substituted polybutadiene |
| 7.5 | Isodecyl pelargonate |
| 0.5 | Epoxide/aziridine hardener. |

The compound is carried out as in Example 1. The burn rate of the propellant at 20° C. and 30 bar is 12 mm/sec. The pressure exponent of the propellant in the range between 30 and 150 bar is 0.09.

EXAMPLE 5

| Percent by Weight | |
|---|---|
| 70.0 | Borap II |
| 8.0 | Aluminum |
| 1.0 | n-Butyl-ferrocene |
| 13.0 | Terminal carboxyl-substituted polybutadiene |
| 7.5 | Isodecyl pelargonate |
| 0.5 | Epoxide/aziridine hardener. |

The compounding is carried out as in Example 1. The burn rate of the propellant at 20° C. and 30 bar is 3 mm/sec. The pressure exponent of the propellant in the range between 30 and 150 bar is 0.57.

EXAMPLE 6

| Percent by Weight | |
|---|---|
| 67.0 | Borap I |
| 5.0 | Magnesium |
| 2.0 | Nitro-guanidine |
| 2.0 | Lithium fluoride |
| 2.0 | n-Butyl-ferrocene |
| 10.0 | Terminal hydroxyl-substituted polybutadiene |
| 9.2 | Diisooctyl sebacate |
| 2.8 | Diisocyanate hardener. |

The components are admixed at 50° C. into a pourable mass which, after eight days at 50° C., hardens into a rubber-elastic mass. The burn rate of the propellant at 20° C. and 30 bar is 4 mm/sec. The pressure exponent of the propellant in the range between 30 and 150 bar is 0.60.

EXAMPLE 7

| Percent by Weight | |
|---|---|
| 70.0 | Borap II |
| 5.0 | Magnesium |
| 2.0 | Nitro-guanidine |
| 2.0 | n-Butyl-ferrocene |
| 10.0 | Terminal hydroxyl-substituted polybutadiene |
| 8.2 | Diisooctyl sebacate |
| 2.8 | Diisocyanate hardener. |

The compounding is carried out as in Example 6. The burn rate of the propellant at 20° C. and 30 bar is 3 mm/sec. The pressure exponent of the propellant in the range between 30 and 150 bar is 0.62.

The invention makes it possible to provide composite solid propellants with elevated pressure exponent n and improved combustion effect degree.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A composite solid propellant with a stable burning rate comprising ammonium perchlorate; a binder system of telomeric polybutadiene or copolymers of butadiene and acrylonitrile with terminal functional groups or functional groups distributed statistically along the chain, which are hardened by means of corresponding hardeners into rubber-elastic binders; finely pulverized, readily oxidizable metals and, optionally, inorganic fluorides, plasticizers and burning rate moderators, wherein ammonium perchlorate together with one or more of said finely pulverized metals, as well as, optionally, said inorganic fluorides are present as an agglomerate of larger particles having a particle size of between 100 μm and 2,000 μm, said agglomerate consists of 19% to 61% by weight of ammonium perchlorate with an average particle size of 0.4 μm to 10 μm; 38% to 75% by weight of boron with a purity of 86% to 99% and an average particle size of 0.5 μm to 5 μm; 1% to 5% by weight of fluorides selected from the group consisting of alkali metal fluorides and cryolites of the formula:

$M_3AlF_6$ where M is an alkali metal, as well as an agglomeration auxiliary agent in amounts of 1% to 10% by weight.

2. The composite solid propellant of claim 1, wherein said agglomerate contains said boron with a purity of 95% to 97% and an average particle size of from 1 μm to 3 μm.

3. The composite solid propellant of claim 1, wherein said agglomerate contains from 4% to 6% by weight of said agglomeration auxiliary agent.

4. The composite solid propellant of claim 1, wherein the agglomerate has a particle size of between 200 μm and 1,200 μm.

5. The composite solid propellant of claim 1, wherein said agglomeration auxiliary agent is soluble in an organic solvent and is selected from the group consisting of polymethylmethacrylate, polystyrene, polyamides, polyvinylpyrrolidone and polyester resins.

6. An agglomerated boron/fluoride perchlorate for use in a solid propellant having a stable burning rate consisting essentially of from:

19% to 61% by weight of ammonium perchlorate with an average particle size of 0.4 μm to 10 μm;

38% to 75% by weight of boron with a purity of 86% to 99% and an average particle size of 0.5 μm to 5 μm;

1% to 5% by weight of fluorides selected from the group consisting of alkali metal fluorides and cryolites of the alkali metals of the formula $Me_3AlF_6$;

where m is an alkali metal;

as well as an agglomeration auxiliary agent in amounts of from 1% to 10% by weight.

7. A composite solid propellant with a stable burning rate consisting essentially of:

40% to 80% by weight of an agglomerate of boron and ammonium perchlorate consisting essentially of from:

19% to 61% by weight of ammonium perchlorate with an average particle size of 0.4 μm to 10 μm;

38% to 75% by weight of boron with a purity of 86% to 99% and an average particle size of 0.5 μm to 5 μm;

1% to 5% by weight of fluorides selected from the group consisting of alkali metal fluorides and cryolites of the alkali metals of the formula $Me_3Alf_6$;

where M is an alkali metal;

as well as an agglomeration auxiliary agent in amounts of from 1% to 10% by weight;

0% to 15% by weight of finely-divided, readily oxidizable metals;

10% to 40% by weight of a binder system selected from the group consisting of telomeric polybutadiene and copolymers of butadiene and acrylonitrile, both with terminal functional groups or functional groups distributed statistically along the chain, which are hardened by means of corresponding hardeners into rubber-elastic binders, and 0 to 5% by weight of burning rate moderators.

8. The composite solid propellant of claim 7, wherein said 10% to 40% by weight of binder system consists of:

8% to 20% by weight of the total propellant of said polybutadiene or copolymers of butadiene and acrylonitrile, with said functional groups, 0.5% to 5% by weight of the total propellant of said hardeners, and 0% to 20% by weight of the total propellant of plasticizers.

* * * * *

UNITED STATES PATENT AND TRADEMARK OFFICE

CERTIFICATE OF CORRECTION

PATENT NO. : 5,139,587

DATED : August 18, 1992

INVENTOR(S) : Rüdiger Strecker et al

It is certified that error appears in the above-identified patent and that said Letters Patent is hereby corrected as shown below:

Column 2, line 10, "$Me_3AlF_6$" should read --$M_3AlF_6$--.

Column 3, lines 1 and 20, "$Me_3AlF_6$" should read --$M_3AlF_6$--.

Column 3, line 33, "$MGF_2$" should read --$MgF_2$--.

Column 8, lines 20 and 40, "$Me_3AlF_6$" should read --$M_3AlF_6$--.

Column 8, line 23, "where m" should read --where M--.

Signed and Sealed this

Eighteenth Day of January, 1994

*Attest:*

*Attesting Officer*

BRUCE LEHMAN

*Commissioner of Patents and Trademarks*